United States Patent [19]

Gogniat

[11] 4,440,505

[45] Apr. 3, 1984

[54] WATCHCASE HAVING A THIN APPEARANCE WHEN BEING WORN

[75] Inventor: Paul Gogniat, Bienne, Switzerland

[73] Assignee: Montres Rado S.A., Longeau, Switzerland

[21] Appl. No.: 400,372

[22] Filed: Jul. 21, 1982

[30] Foreign Application Priority Data

Aug. 10, 1981 [CH] Switzerland ..... 5129/81

[51] Int. Cl.[3] ..... G04B 37/00

[52] U.S. Cl. ..... 368/292; 368/300

[58] Field of Search ..... 368/291–296, 368/286, 276, 300; 29/177, 179

[56] References Cited

U.S. PATENT DOCUMENTS 3,355,874 12/1967 Paratte ..... 368/291
4,281,406 7/1981 Tawaka ..... 368/300
4,397,566 8/1983 Lederrey ..... 368/300

FOREIGN PATENT DOCUMENTS 2308970 11/1976 France ..... 368/276
2251044 11/1978 France ..... 368/291
184669 8/1936 Switzerland ..... 368/286
613591 10/1979 Switzerland .

*Primary Examiner*—Bernard Roskoski
*Attorney, Agent, or Firm*—Peter L. Berger

[57] ABSTRACT

The watch case comprises, notably, a case band 1, a crystal 14 and a back 5 detachably mounted on the case band and a caging ring 6 assuring the positioning of a movement 22 in the case. The case band 1 has an upper opening 2 designed to be sealed by the crystal and a smaller-sized lower opening 3 defined by a projection 7 radially extending inward to its lower part. The caging ring 6 has an upper portion 10 and a lower portion 11 containing outer surfaces 12, 13, the dimensions of which correspond respectively to those of the upper opening 2 and lower opening 3 of the case band 1, the ring 6 being insertable in the latter through its upper opening before mounting of the crystal and placed so that its lower portion 11 is engaged in the lower opening 3 of the case band 1. The back 5 is held against the lower surface 8 of the projection 7 of the case band by means of set screws 9, tightening of which assures the locking of the caging ring 6 in the case.

12 Claims, 3 Drawing Figures

WATCHCASE HAVING A THIN APPEARANCE WHEN BEING WORN

BACKGROUND AND SUMMARY OF THE INVENTION

This invention concerns watch cases, and it more specifically concerns a watch case containing a case band on which a back and a crystal are detachably mounted, and in which a movement can be positioned by means of a caging ring.

An object of the invention is to provide a design of slim watch cases provided with very small-sized means of fastening the back and the crystal. The flat appearance of the watch case is further enhanced by permitting the use of a square-shaped case band receiving a dial and a crystal of large size, while the back can be circular and small-sized, so as not to extend to the edges of the lower part of the case band.

For that purpose, the watch case of this invention uses a back held to the lower part of the case band by means of set screws, the anchoring of those screws and the respective configurations of the case band and caging ring being so determined that tightening of the screws simultaneously assures fastening of the back and locking of the caging ring, the latter also assisting in compressing gaskets, positioning of the crystal and, in some particular embodiments, locking it in place.

DETAILED DESCRIPTION

Figure 1:
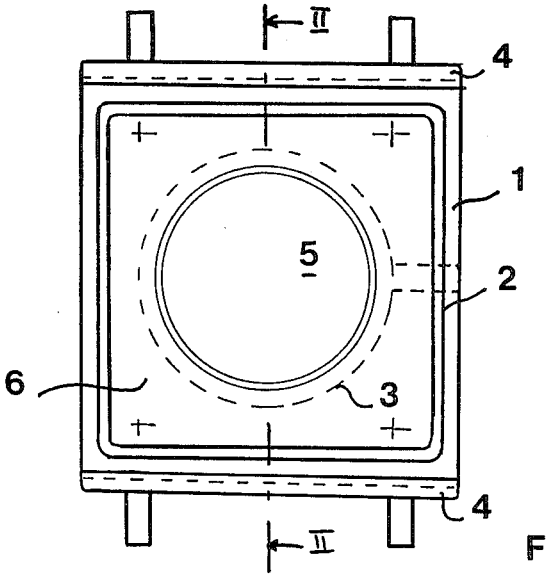
FIG. 1 is a top view of a watch case according to one embodiment of the invention, in which the crystal and the movement have been removed.

As can be seen on FIG. 1, a watch case according to a first embodiment of the invention contains a case band 1, which has a smaller-sized upper opening 2 and lower opening 3. Upper opening 2 is preferably shaped and is designed to be sealed by a crystal (not shown), laterally engaged in stops 4 forming slides extending on two opposite edges of case band 1. Lower opening 3, preferably circular and of reduced diameter, is sealed by back 5. A caging ring 6 is set in place in the case through upper opening 2 of the case band.

Figure 2:
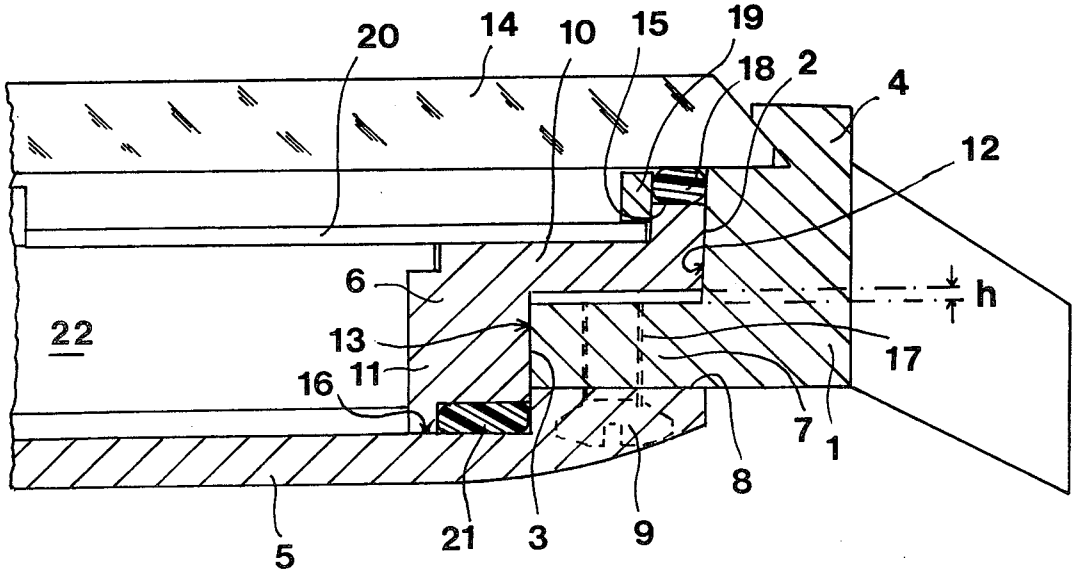
FIG. 2 is a partial view in section along line II—II of the watch case of FIG. 1.

The section of FIG. 2 shows that lower opening 3 of square 1 is defined by a projection 7 extending radially inward, and against the lower surface 8 of which back 5 is held by means of set screws 9.

Ring 6 has an upper portion 10 and a lower portion 11 containing outer surfaces 12 and 13, the dimensions of which correspond respectively to those of upper opening 2 and lower opening 3 of case band 1, its lower portion 11 being engaged in lower opening 3.

In the embodiment represented, in which crystal 14 is held to the upper part of case band 1 by stops 4 forming a slide which prevents it from upward movement, the upper part 10 of ring 6 has a first bearing surface 15 to force the periphery of crystal 14 against stops 4, while its lower portion 11 contains a second bearing surface 16 which comes in contact with back 5. Set screws 9 of back 5, accessible from outside the case, are engaged in threads 17 of case band 1, so that tightening them, after mounting the back, causes, through the action of the back on the bearing surface 16 of the ring, a displacement of the latter in the direction of the crystal, until its bearing surface 15 is supported, either directly or preferably by means of a gasket 18, against the lower periphery of crystal 14, in order to urge against stops 4. A riser 19 is placed on dial 20 in order to hide gasket 18, the top of which is hidden by a metal coating deposited under the crystal. A second gasket 21 can be placed between back 5 and lower portion 11 of ring 6 beside the bearing surface 16 of the latter.

The casing of movement 22 is now described. Ring 6 and movement 22 are inserted in case band 1 through its upper opening 2, and then gasket 18 and riser 19 are set in place before crystal 14 is laterally engaged in its slides. It is then sufficient to fasten back 5, after mounting of gasket 21, by means of screws 9, the tightening of which simultaneously causes back 5 to press against the lower surface 8 of projection 7, ring 6 to lock, crystal 14 to lock and gaskets 18 and 19 to compress. The case is disassembled in the opposite manner, and it is sufficient, in order to make removal of the crystal possible, to make sure that a space of height h is provided in the assembled state of the case between the upper portion 10 of ring 6 and the projection 7 of the square, so that, on detaching the back, the ring can be moved sufficiently to relax the pressure it exerts on the crystal.

Figure 3:
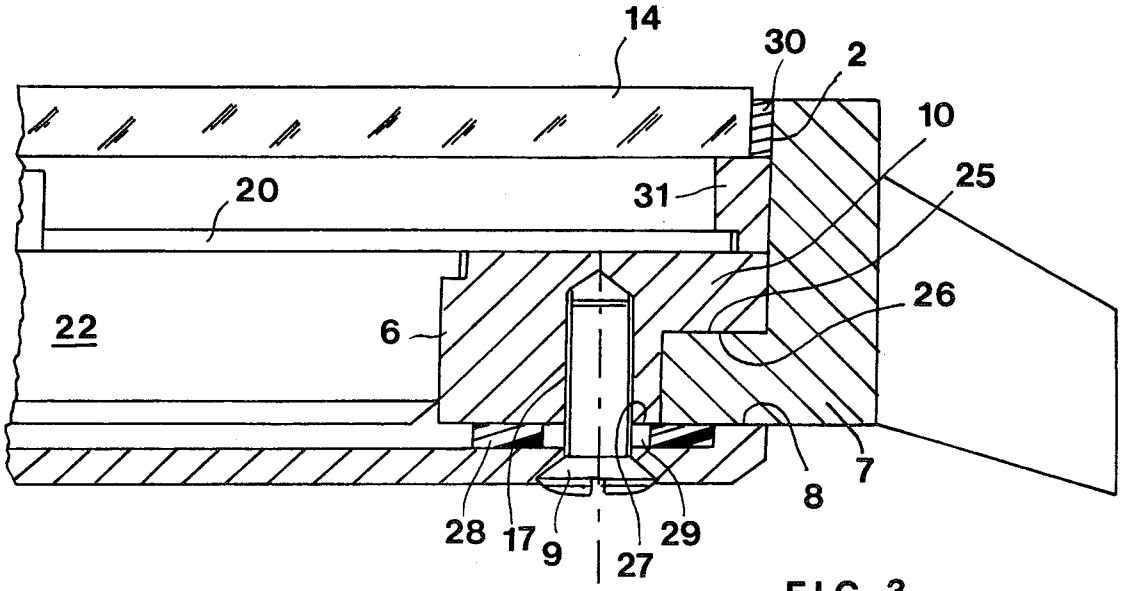
FIG. 3 is a view similar to that of FIG. 2 of a second embodiment of the invention.

FIG. 3 illustrates a second embodiment of a watch case. The same numerals are used to designate similar parts. Screws 9 are engaged in threads 17 formed in ring 6 itself, so that tightening them causes a lower surface 25 of its upper portion 10 to bear against the opposite upper surface 26 of projection 7. The lower surfaces 8 of projection 7 and 27 of ring 6 are then preferably coplanar. A wide ring-shaped gasket 28 containing passages 29 for screws 9 is placed between surfaces 8 and 27 and the opposite surface of the back.

Crystal 14 is driven in known fashion into the upper opening 2 of case band 1, with interposition of an I-section gasket 30. Riser 31 serves as a brace between crystal 14 and ring 6.

The casing is assembled by inserting ring 6 and movement 22 in case band 1 through its upper opening 2, and then the back is applied against the lower surface 8 of projection 7 by tightening screws 9, after mounting the gasket 28, so as simultaneously to lock back 5 and caging ring 6. Riser 31 is next placed on dial 20 and crystal 14 is then driven into opening 2. In order to disassemble the watch, it is sufficient to remove the back 5 and the winding stem and then force out the crystal 14 by exerting a push on the lower part of ring 6 by means of a standard cock, that pressure being transmitted to crystal 14 by means of riser 31.

It is clear that the designs described above in which cases are made with an upper opening of larger dimensions than those of the lower opening allow for a corresponding reduction of the dimensions of the back, the edges as well as set screws of which can then be moved toward the center of the case and are thus more easily hidden from view.

Although it has been described with reference to two particular embodiments, the invention is not at all limited to such embodiments, but rather lends itself to numerous modifications and variants which will be evident to the expert.

What is claimed is:

1. A watch case comprising a case band, a crystal and a back detachably mounted on the case band and a caging ring for positioning a movement of the watch in the case, characterized in that:

the case band has an upper opening sealed by the crystal and a smaller-sized lower opening defined by a projection of said case band radially extending inwardly at the lower part of case band, the caging ring has an upper portion and a lower portion containing outer surfaces, the outer surfaces of said upper and lower portions of said caging ring fitting within the upper and lower openings, respectively, of the case band, the ring being insertable in said case band through its upper opening before the mounting of the crystal and being fit into the lower opening of the case band; and the back is held against the lower surface of the projection of the case band by means of set screws, said set screws being tightened to lock the caging ring in the case, wherein the watch case presents a thinner appearance than it has by providing said smaller lower opening of said case band and said caging ring to enable the edge of the back and said set screws to be moved inwardly so as to be hidden when worn on a wrist.

2. A watch case according to claim 1, wherein the upper opening of the case band is square and its lower opening is round.

3. A watch case according to claims 1 or 2, wherein the crystal is held to the upper part of the case band by stops in which said crystal is laterally engaged, the upper portion of the caging ring having a first bearing surface in contact with the periphery of the crystal to push said periphery against said stops, the lower portion of said ring containing a second bearing surface which contacts the back, the set screws engaging threads formed in the case band so that tightening said set screws causes the caging ring to move toward the crystal.

4. A watch case according to claim 3, further comprising a gasket placed between the crystal and the first bearing surface of the caging ring to be compressed as the set screws are tightened.

5. A watch case according to claim 3, further comprising a gasket placed between the back and the lower portion of the caging ring beside said second bearing surface.

6. A watch case according to claim 4, further comprising a gasket placed between the back and the lower portion of the caging ring beside said second bearing surface.

7. A watch case according to claims 1 or 2, wherein the set screws engage threads formed in the caging ring, so that as said set screws are tightened a lower bearing surface of the upper portion of the caging ring moves against a corresponding surface of the projection of the case band.

8. A watch case according to claim 7, wherein the lower surfaces of the projection of the case band and of the caging ring are coplanar, further comprising a wide ring-shaped seal containing passages for the set screws being placed in the space defined between said coplanar surfaces and the facing surface of the back.

9. A watch case according to claim 7, wherein the crystal is driven into the upper opening of the case band, with an I-section seal interposed between said case band and the facing surface of said crystal.

10. A watch case according to claim 8, wherein the crystal is driven into the upper opening of the case band with an I-section seal interposed between said case band and the facing surface of said crystal.

11. A watch case according to claim 9, further comprising a riser forming a brace between the crystal and the upper portion of the caging ring.

12. A watch case according to claim 10, further comprising a riser forming a brace between the crystal and the upper portion of the caging ring.

* * * * *